United States Patent [19]

Hofmann et al.

[11] 4,216,984

[45] Aug. 12, 1980

[54] AUTOMATIC LOCKING LATCH

[75] Inventors: Robert A. Hofmann; David W. Kusche, both of Oshkosh, Wis.

[73] Assignee: Brunswick Corporation, Skokie, Ill.

[21] Appl. No.: 1,436

[22] Filed: Jan. 8, 1979

[51] Int. Cl.[3] ..... E05C 11/00

[52] U.S. Cl. ..... 292/91; 292/DIG. 38

[58] Field of Search ..... 292/91, 265, DIG. 38; 24/201 C

[56] References Cited

U.S. PATENT DOCUMENTS

| | | | |
|---|---|---|---|
| 2,914,936 | 12/1959 | Reinold | 24/201 C X |
| 2,996,325 | 8/1961 | Chenel | 292/265 |
| 3,682,163 | 8/1972 | Plummer | 24/201 C |
| 3,822,905 | 7/1974 | Bell | 292/DIG. 38 |

*Primary Examiner*—Richard E. Moore

[57] ABSTRACT

A latching apparatus for cowls on outboard motors which catches and locks automatically, but can be released by simply pushing with one hand. Two saw-toothed semi-rigid mating parts are oriented with leading edges and mating teeth facing in a manner so that they interfere slightly when mated. As the parts approach each other, opposing teeth ride on each other and slip past one after another until all teeth interlock. Release is accomplished by a slight force transverse to the latching motion, thus disengaging the teeth and allowing withdrawal.

6 Claims, 1 Drawing Figure

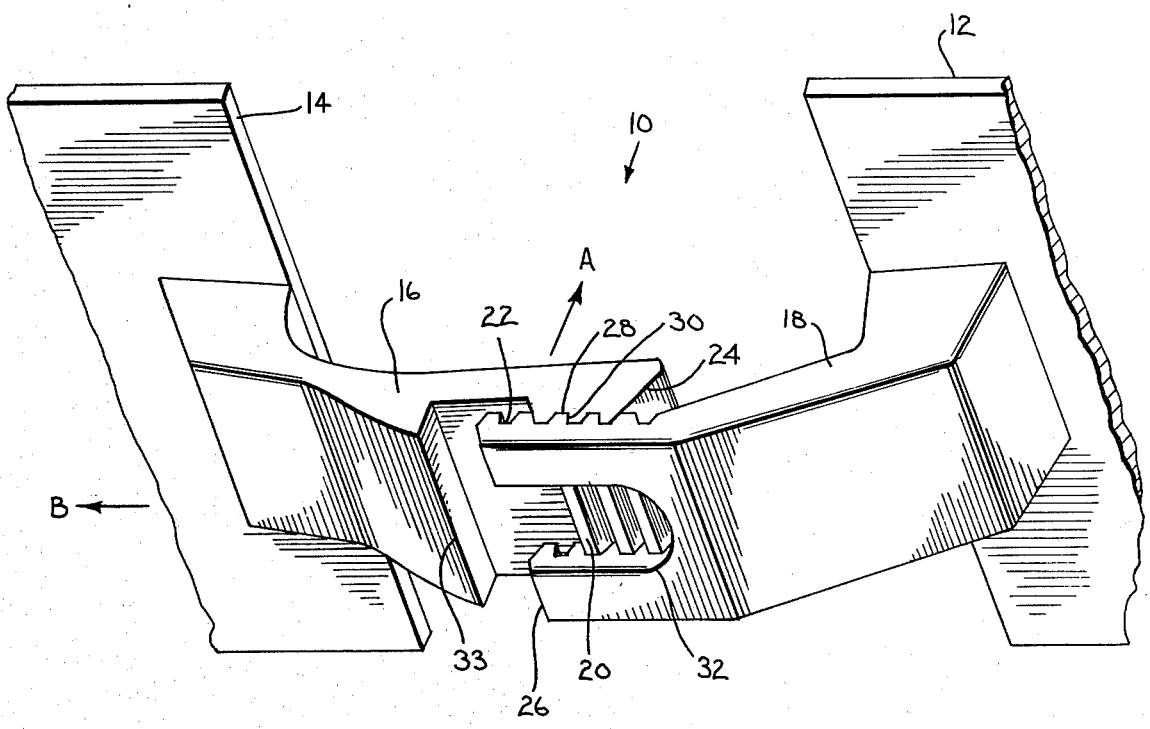
12
14
10
A
16
22
28
30
24
18
B
33
26
20
32

AUTOMATIC LOCKING LATCH

BACKGROUND OF THE INVENTION

This invention relates generally to cowls for outboard motors and more specifically to a latching means for the clam-shell type cowl which encloses the engine of some outboard motors. A cowl assembly is provided to enclose the upper portion of the engine and is suitably constructed and mounted to suppress engine noise and to protect the boat occupants from contact with the engine. While for small outboard motors, single piece cowls are used because they impose no severe difficulties in installation and removal, for larger engines the approach generally used is one of cowls with at least two parts, frequently of a clam-shell type. Such a cowl wraps around the engine sides and top in two pieces, each hinged aft, with the forward ends of the half cowls connected by some quick latching means.

The prior art quick latch means which have been used all required some special action on the part of the user to accomplish the latching action and use essentially a reversal of that same action to unlatch the cowls. One typical latch is little more than a glorified rubber band. An elastomer member is permanently attached to one part of the cowl and stretched to engage a hook on the other side of the cowl. The latching action of such a device is directly dependent on the tension applied, and, therefore, its action requires some strength on the part of the user. Moreover, the elasticity of such stretchable materials varies with age and is likely to weaken or fail from prolonged exposure to the elements.

Another available latch involves a mechanical apparatus essentially similar to a turnbuckle. End fittings such as T-bars are used to interlock with a pair of fingers on each half of the cowl, and a threaded fitting common to both T-bars is used to tighten the latch after engagement, or to loosen it before release.

While the prior art devices are called quick-acting, in truth, they are not. All require specific latching and unlatching actions which are time consuming and, under some circumstances, such as with cold or wet hands, can be difficult to accomplish.

It is an object of this invention to furnish a latching means which is not only truly quick acting, but is also automatic, requiring no action on the part of the user other than joining the half-cowls.

It is another object of this invention to furnish a latching means which requires only a very simple action to accomplish release and therefore permits such latch release and opening of the cowl under adverse conditions.

SUMMARY OF THE INVENTION

These objectives are accomplished by the present invention for which the preferred embodiment is a pair of mating toothed surfaces which, because they are oriented to create a slight mechanical interference, interlock as they meet.

Each of the two parts of the latch is constructed essentially as one half of a cantilevered arch, with the base of each arch attached to one half of the cowl. As the cowl halves approach each other, the latch parts meet at their projecting ends. These leading edges are designed so that, when attached to cowl halves which are in the same plane, the latch parts mechanically interfere, that is, the leading edges touch. The latch parts are, however, designed to always ride past each other in a prescribed orientation, with particular surfaces mating. This is accomplished by slight dimensional differences in the parts and by means of wedge shape leading edges which meet first and determine the orientation in which the parts will pass each other.

The opposing surfaces of each latch part have mating tooth-like ridges which favor motion in the direction of the motion during latching. As each tooth rides over a tooth on the mating surface it catches on the opposing tooth, and reverse motion is prevented. When the cowl halves are themselves at their limit of travel, the latch parts are resting, one upon the other, with all teeth engaged, fully preventing any motion in the direction of opening. The force compressing the two parts because the inner latch piece is being distorted inward toward the cowl and the outer one is pushed outward by the wedge shape, prevents accidental disengagement of the teeth.

When unlatching is desired all that is required is slight movement to separate the innermost latch part from the outer one, thus releasing the teeth. This movement is accomplished very simply by pressing on the inner piece with the thumb. The force needed is not great, and neither skill nor precision is required, so that it can be done regardless of experience.

The present invention has the further advantage of simplicity of construction. Since it has only two parts, both of which can be produced by casting processes, it is also less expensive to produce than previous art devices, and, furthermore, can be made of non-corroding materials such as plastic. Molded resin is, in fact, a preferred material since its low friction nature aids in the interaction of the ridged surfaces during latching.

BRIEF DESCRIPTION OF THE DRAWING

The FIGURE is a perspective view of the invention mounted on portions of a clam-shell cowl.

DETAILED DESCRIPTION OF THE INVENTION

The preferred embodiment of the invention selected for illustration is shown pictorially in the FIGURE where latch 10 is mounted on half cowls 12 and 14 by conventional bonding or fasteners (not shown). Latch 10 is constructed of two parts, inner catch 16 and outer catch 18, formed as cantilever half arches, each of which have tooth-like ridges 20 and 22, formed by multiple parallel ridges and grooves oriented transverse to the motion of the closing cowl halves. Outer catch 18 has ridges and grooves 22 facing inward and inner catch 16 has ridges and grooves 20 facing outward. The ridges and grooves face each other and are complimentary to the extent that they interlock with each other.

Catch 16 is constructed with wedge shaped leading edge 24 whose distance from the plane of half cowls 12 and 14 is just slightly less than the distance which leading edge 26 of catch 18 stands away from the same plane. These distances are such that, as half cowls 12 and 14 approach each other during closing to cover the engine (not shown), leading edges 24 and 26 actually collide. However, since leading edge 24 is slightly inward and wedge shaped, and because the structure of the catches yield somewhat, leading edge 24 always moves inward, so that its ridges 20 ride across ridges 22 of catch 18.

The ridges ride across each other easily because of a slight rake to each leading edge 28 which favors such direction of motion, but once past each other, an almost perpendicular trailing edge 30 restricts backward movement. Catches 16 and 18 therefore interlock, and will not separate, because of the force compressing them together caused by the slight distortion resulting from the interfering action.

Disengagement requires a positive, but very simple action. Catch 16 must be moved slightly in direction A, perpendicular to the plane of the ridges, in toward the cowls, in order to disengage ridges 20 from ridges 22 and then it must be pushed in direction B, parallel to the plane of the ridges, to slip ridges 20 past ridges 22. To aid in these motions, cutout 32 is made in catch 18, affording access to the end of catch 16, to permit perpendicular force to be applied to catch 16 by simple thumb pressure. Thumb retainer 33, a surface perpendicular to the plane of the ridges, is built onto catch 16 to enable the motion parallel to the plane of the cowls to be imparted to catch 16.

It is to be understood that the form of the invention herein shown is merely a preferred embodiment. Various changes may be made in the size, shape and the arrangement of parts; equivalent means may be substituted for those illustrated and described; and certain features may be used independently from others without departing from the spirit and scope of the invention as defined in the following claims.

For example, catch 16 may itself be cut away in those areas where ridges 20 are shown exposed under cutout 32, or ridges 20 at that location may be replaced with a thumb pad. Moreover, catch 16 can be built with protruding ears to permit application of the required disengaging forces.

What is claimed as new and desired to be secured by Letters Patent of the United States is:

1. A latch for use with removable outboard motor cowls comprising:

a first catch, attached to a first cowl member;

an area on a surface of said first catch which contains a first series of multiple parallel ridges and grooves running transverse to the final direction of motion of closing of the cowls, said area lying in a plane parallel to said direction of closing;

a semi-rigid second catch, attached to a second cowl member to be latched to the first cowl member, oriented to mechanically interfere with the first catch at the leading edges as said cowl members approach each other, and constructed to slip past the first catch onto the area of the first series of ridges and grooves and to maintain one of its surfaces in forcible contact with the first series of ridges and grooves;

an area, on that surface of the second catch which contacts the first series of ridges and grooves, containing a second series of multiple parallel ridges and grooves, the second series of ridges and grooves being parallel to, directly facing, essentially overlapping, and interlocking with the first series of ridges and grooves when the leading edge of the second catch has slipped past the leading edge of the first catch and the latching motion is essentially complete; and a means of applying force perpendicular to the plane of the ridges and grooves whereby the interlocking ridges and grooves are disengaged.

2. A latch for use with removable outboard motor cowls as in claim 1 wherein the means of applying perpendicular force is a cutout removed from one of the catches permitting access to the other catch.

3. A latch for use with removable outboard motor cowls as in claim 1 further comprising a means of applying force parallel to the plane of the ridges whereby the ridges and grooves, once disengaged, may be moved from an overlapping orientation.

4. A latch for use with removable outboard motor cowls as in claim 4 wherein the means for application of parallel force is a surface perpendicular to the plane of the ridges, attached to one of the catches.

5. A latch for use with removable outboard motor cowls as in claim 1 wherein the first and second catches are constructed of low friction molded resin to facilitate the slippage of one area of ridges across the other.

6. A latch for use with removable outboard motor cowls comprising:

a first catch in the form of a cantilever half arch, attached to a first cowl member;

an area on a surface of said first catch which contains a first series of multiple parallel ridges and grooves running transverse to the final direction of motion of closing of the cowls;

a semi-rigid second catch in the form of a cantilever half arch, attached to a second cowl member to be latched to the first cowl member, oriented to mechanically interfere with the first catch at the leading edges as it approaches the first catch, and constructed to slip past the first catch onto the area of the first series of ridges and grooves and to maintain one of its surfaces in forcible contact with the first series of ridges and grooves; and an area, on that surface of the second catch which contacts the first series of ridges and grooves, containing a second series of multiple parallel ridges and grooves, the second series of ridges and grooves being parallel to, directly facing, essentially overlapping, and interlocking with the first series of ridges and grooves to form a full arch of the first and second catches when the leading edge of the second catch has slipped past the leading edge of the first catch and the latching motion is essentially complete.

* * * * *